US005492424A

United States Patent [19]

Hori et al.

[11] Patent Number: 5,492,424

[45] Date of Patent: Feb. 20, 1996

[54] CARRIAGE-CONNECTING DEVICE IN A SERIAL PRINTER

[75] Inventors: Takashi Hori; Hirotomo Tanaka; Toshio Kuriyama, all of Nagano, Japan

[73] Assignee: Seiko Epson Corporation, Tokyo, Japan

[21] Appl. No.: 309,159

[22] Filed: Sep. 20, 1994

[30] Foreign Application Priority Data

Sep. 20, 1993 [JP] Japan ..... 5-233097

[51] Int. Cl.[6] ..... B41J 29/02

[52] U.S. Cl. ..... 400/693; 400/320; 400/175; 361/749

[58] Field of Search ..... 400/175, 692, 400/693, 320, 352; 174/254; 361/749; 347/108, 170; 346/145

[56] References Cited

U.S. PATENT DOCUMENTS

| | | | |
|---|---|---|---|
| 3,958,254 | 5/1976 | Okabe | 400/175 |
| 4,748,293 | 5/1988 | Kikuchi et al. | 174/254 |
| 4,890,194 | 12/1989 | Derryberry et al. | 361/386 |
| 4,987,442 | 1/1991 | Vemori | 361/749 |
| 5,074,692 | 12/1991 | Mizutani et al. | 400/692 |
| 5,134,252 | 7/1992 | Himeno et al. | 174/254 |
| 5,296,651 | 3/1994 | Gurrie et al. | 174/254 |
| 5,322,974 | 6/1994 | Walston | 174/254 |

*Primary Examiner*—Ren Yan
*Assistant Examiner*—John S. Hilten
*Attorney, Agent, or Firm*—Sughrue, Mion, Zinn, Macpeak & Seas

[57] ABSTRACT

A serial printer is disclosed in which a serial printer body is connected to a carriage via a cable. The carriage is driven by electric power supplied through the cable, and signals are also transmitted between the serial printer body and the carriage through the cable. The cable comprises a sheet-like substrate and a plurality of conductive strips which are formed on the sheet-like substrate and which extend in a longitudinal direction of the sheet-like substrate. The plurality of conductive strips includes at least one wide conductive strip for supplying the electric power and at least one narrow conductive strip for transmitting the signals. The wide and narrow conductive strips are arranged such that noise created by the electric power supplied by the wide conductive strip does not interfere with the signals transmitted in the narrow conductive strip.

15 Claims, 7 Drawing Sheets

ABC
40
35
34
33
36
31
32
20
22
30
24
21
10

CARRIAGE-CONNECTING DEVICE IN A SERIAL PRINTER

BACKGROUND OF THE INVENTION

1. Field of the Invention

This invention relates to serial printers, and more particularly to a device in a serial printer for driving a carriage on which a printing head is mounted.

2. Description of the Related Art

In order to drive a carriage which supports a printing head, a stepping motor is typically used. The stepping motor drives the carriage by driving a belt coupled to the carriage. However, even though a stepping motor can accurately position the carriage, a stepping motor is relatively expensive to manufacture.

On the other hand, a DC motor is a less expensive alternative means with which to drive the belt. In addition, a DC motor is usually contained in a printer of a large scale computer that prints a large amount of data in a short period of time. However, unlike a stepping motor, a DC motor has a rotary shaft which rotates at high speeds and provides a lot of torque. Therefore, since the high speed rotary shaft of the DC motor drives the belt, another device is needed to determine the distance that the belt has moved. An encoder is typically used to measure the distance moved by the belt and outputs a signal which represents the measured distance. Subsequently, the output signal and a separate clock pulse signal are utilized to synchronize the printing of the printing head on the carriage. The encoder may be a rotary encoder or a linear encoder, but, in order to print high quality characters at high speeds, a linear encoder is used in most instances.

In order to supply the output signal of the linear encoder from the carriage to the printer body, a flexible pattern circuit (FPC) is employed. An FPC is basically a flat cable constructed of a flexible substrate which contains conductive patterns on its surface. In addition to transmitting the output signal of the linear encoder, the FPC also supplies current from the printer body to the printing head in order to drive the printing head.

Since detecting the position of the carriage on the carriage drive shaft is essential to synchronize the operation of the printing head, a circuit which instantaneously calculates the position and the direction of the movement of the carriage from the output signal of the linear encoder is provided on the carriage. However, the carriage of a printer thus constructed is bulky and accordingly the carriage-driving device is bulky.

FIG. 7 is an illustration of the waveforms of the current supplied to the printing head and of the output signals transmitted by the encoder. As shown by the waveforms $V_A$ and $V_B$, the encoder signals have a significant amount of noise at the rise and fall of the current $I_P$ that is supplied to the printer head.

FIG. 8 shows a portion of a conventional shielded FPC which is used to reduce the noise of the encoder signals $V_A$ and $V_B$. The FPC is made of three separate layers. The top layer is a layer of conductive strips 21 which supply the current $I_P$ to the printing head. The bottom layer is a layer of conductive strips 22 which supply current to the encoder, transmit the output signal of the encoder to the printing body, and contain a ground.

The middle layer comprises an electrostatic shielding member 23. The electrostatic shielding member 23 prevents the current $I_P$ from creating noise in the output signals $V_A$ and $V_B$ of the encoder. However, the electrostatic shielding member 23 is expensive, and there has been a demand for an FPC which has a different structure and is less expensive than a convention FPC.

In view of the foregoing, an object of the invention is to provide a carriage-driving device for a serial printer which the connects the printer body to the carriage through a less expensive FPC.

SUMMARY OF THE INVENTION

The foregoing object of the invention has been achieved by a carriage-driving device for a serial printer in which a serial printer body is connected to a carriage via a cable. The carriage is driven by electric power supplied to the carriage through the cable, and signals are transmitted between the serial printer body and the carriage through the cable. The cable of the present invention comprises a sheet-like substrate and a plurality of conductive strips which are formed on the substrate and which extend in a longitudinal direction of the sheet-like substrate.

The plurality of conductive strips include at least one wide conductive strip which supplies the electric power and at least one narrow conductive strip for transmitting the signals. The wide and narrow conductive strips are arranged such that the electric power supplied by the wide conductive strips does not create a significant amount of noise in the signals transmitted in the narrow conductive strips.

In one embodiment of the carriage-driving device, the sheet-like substrate has a plurality of layers, at least two of which comprise a substrate and conductive strips. Of the two types of conductive strips formed on the sheet-like substrate, the wide conductive strips are suitable for supplying current to the printing head, and the narrow conductive strips are able to transmit the output signals of the encoder. Furthermore, due to the width of the narrow conductive strips, they are not able to supply current to the printing head. When current is supplied to the printing head through the wide conductive strips, the current creates electrostatic and electromagnetic noise in the signals transmitted in the narrow conductive strips. However, the effects of the electrostatic and the electromagnetic noise between the two types of conductive strips are decreased as the distance between the two types of conductive strips is increased. Hence, although both the wide and narrow conductive strips are formed within the same cable, the effect of the noise on the narrow conductive strips is extremely slight because the narrow conductive strips are separated from the wide conductive strips. Furthermore, the small width of the narrow conductive strips further reduces the effects of the electromagnetic induction and the electrostatic coupling from the wide conductive strips. In the case where the multi-layered sheet-like substrate is constructed such that the wide conductive strips are arranged on one layer and the narrow conductive strips are arranged on another layer, the effect of the electromagnetic induction is further reduced.

DESCRIPTION OF THE PREFERRED EMBODIMENTS

Figure 1:
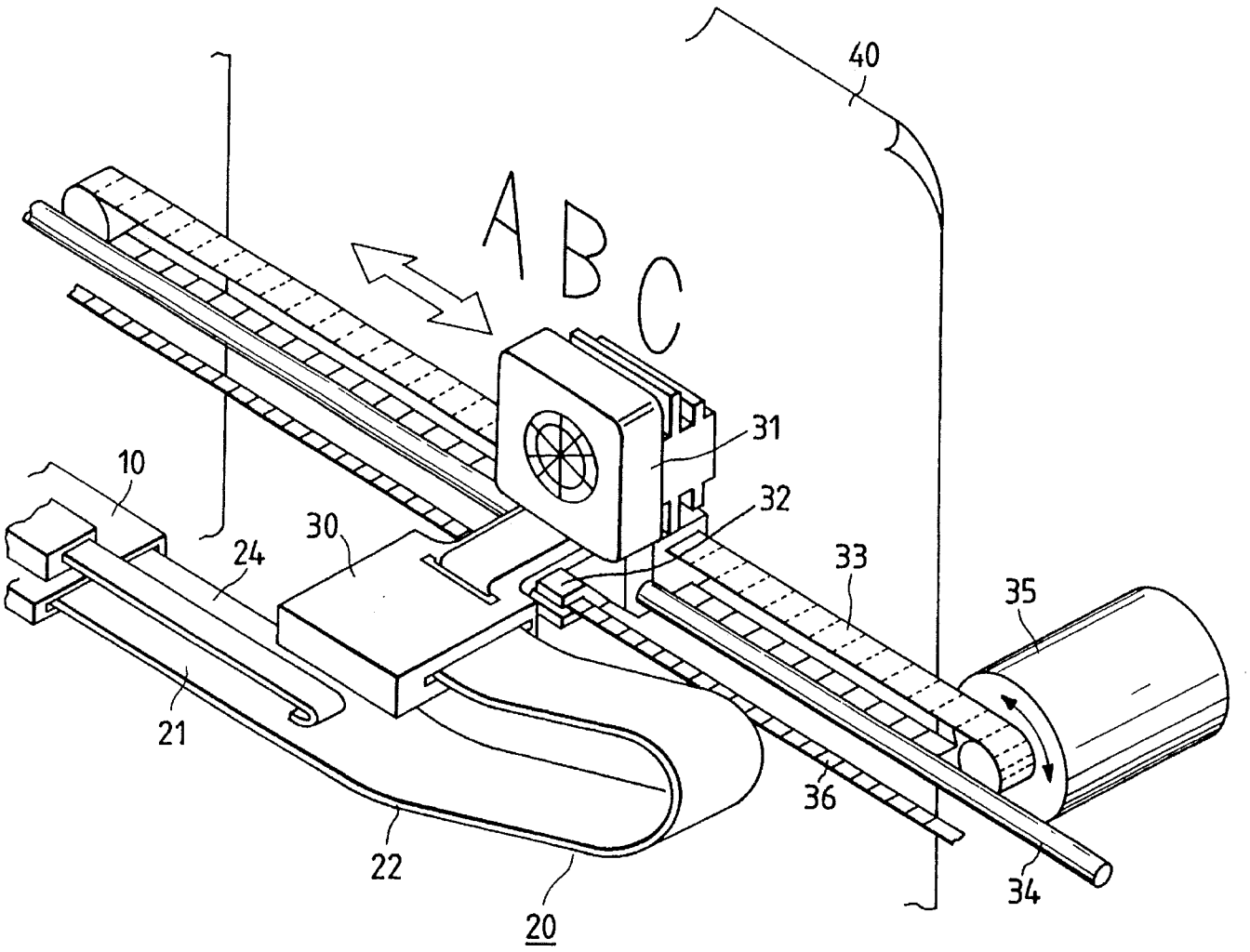
FIG. 1 is a perspective view of a carriage and other components in a serial printer.

FIG. 1 shows a carriage 30 and other components of a serial printer. The carriage 30 is connected to a cable connecting section 10 via a flexible pattern circuit (FPC) 20. The FPC 20 comprises a first layer 21 and a second layer 22, and is pressed downward by a pressing member 24.

A printing head 31 and a linear encoder 32 are mounted on the carriage 30, and the carriage 30 is fixedly secured to a driving belt 33 so that it can be moved along a carriage movement shaft 34. The driving belt 33 is driven by the rotatable shaft of a DC motor 35, and the rotatable shaft causes the driving belt 33 to move the carriage 30 in the directions of the double-head arrow. While the carriage 30 is moving, the linear encoder 32 optically reads the amount of movement of the carriage 30 from a scale 36 and converts the amount of movement into an output signal. In addition, as the carriage 30 moves, the printing head 31 prints characters on a recording sheet 40.

Figure 2:
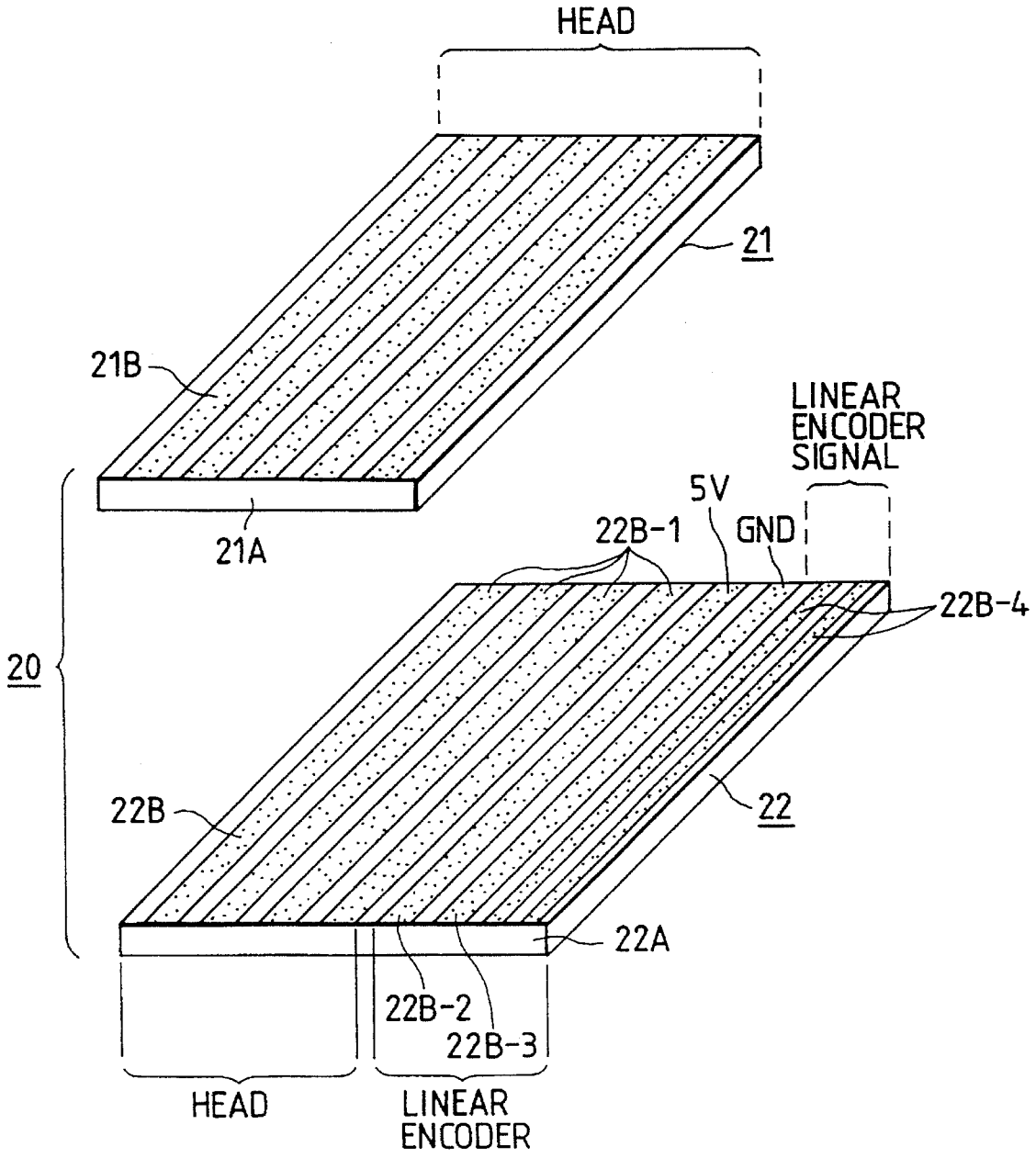
FIG. 2 is a perspective view of a cable 20 of the present invention, with a first layer 21 and a second layer 22 separated from each other.

FIG. 2 shows one example of an FPC 20 of the present invention. The FPC has a first layer 21 and a second layer 22 (which are shown separated from each other for illustration purposes). The first layer 21 is made up of a sheet-like substrate 21A and five conductive strips 21B which supply a current to the printing head 31. The second layer 22 is made up of a sheet-like substrate 22A on which eight conductive strips 22B formed. Of the eight conductive strips 22B, the wide conductive strips 22B-1 supply current to the printing head 31 and are located on the left-most portion of the substrate in FIG. 2. Of the remaining four conductive strips, a supply voltage strip 22B-2 supplies a voltage to the linear encoder 32, a ground strip 22B-3 serves as a ground, and two narrow conductive strips 22B-4 transmit the output signal provided by the linear encoder 32 to the printer body.

Therefore, the two narrow conductive strips 22B-4, which transmit the output signal of the linear encoder 32, are separated from the four wide conductive strips 22B-1 by the ground strip 22B-3 and the supply voltage strip 22B-2. Consequently, any abrupt change in the current supplied to the printing head 31 does not create a significant amount of electromagnetic or electrostatic noise in the output signal of the linear encoder 32. In addition, the output signal of the linear encoder 32 is not significantly affected by the flow of current in the five conductive strips 21B of the first layer 21.

Figure 3:
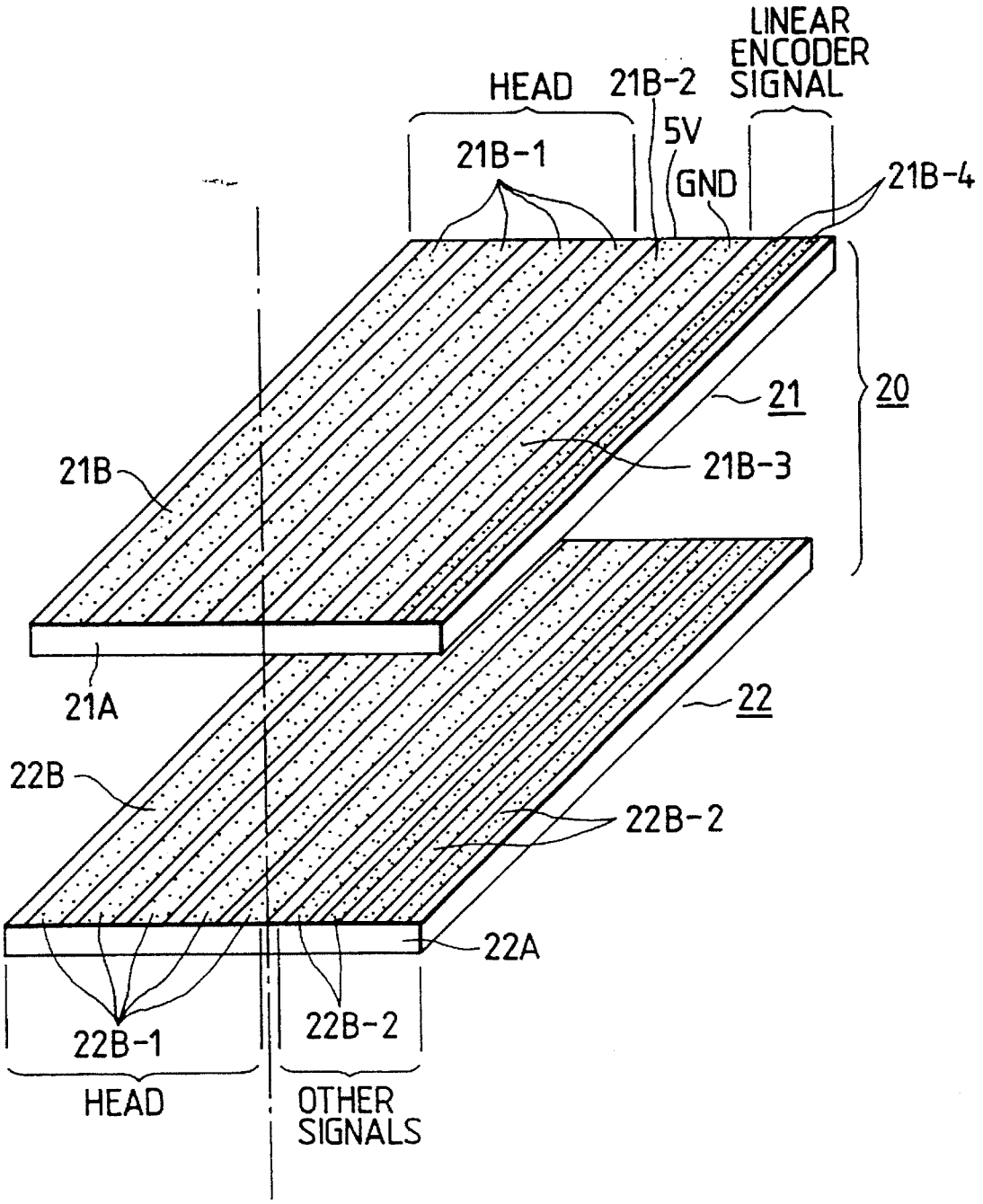
FIG. 3 is a perspective view of another example of a cable 20 of the present invention with a first layer 21 and a second layer 22 separated from each other.

FIG. 3 shows another example of the FPC 20 of the present invention. The FPC 20 similarly has a first layer 21 and a second layer 22 (which are shown separated from each other for illustration purposes). Both the first layer 21 and second layer 22 have conductive strips 21B and 22B which supply current to the printing head 31 and which transmit various other signals. The first layer 21 has four wide conductive strips 21B-1 which supply current to the printing head 31 and two narrow conductive strips 21B-4 which transmit the output signals of the linear encoder 32 to the printer body. The wide conductive strips 21B-1 and the narrow conductive strips 21B-4 are separated by a supply voltage strip 21B-2 and a ground strip 21B-3. Therefore, the wide conductive strips 21B-1 and the narrow conductive strips 21B-4 are located at opposite sides of the sheet-like substrate 21A.

The second layer 22 has five wide conductive strips 22B-1 which supply current to the printing head 31 and four narrow conductive strips 22B-2 which transmit other signals on the sheet-like substrate 22A. Furthermore, the conductive strips 22B-1 and the conductive strips 22B-2 are located at opposite sides of the sheet-like substrate 22A.

In both the first layer 21 and the second layer 22, the wide conductive strips 21B-1 and 22B-1 are located on the left-most portion of the first substrate 21 and the second substrate 22. In addition, the narrow conductive strips 21B-4 and 22B-2 are located on the right-most portion of the first substrate 21 and the second substrate 22. In other words, the wide conductive strips which create noise are arranged on the left-most portion of the substrates, and the narrow conductive strips which are affected by the noise are arranged on the right-most portion of the substrates. As a result, the problem of noise interfering with the transmitted signals are eliminated without a separate, expensive shielding member.

Figure 4:
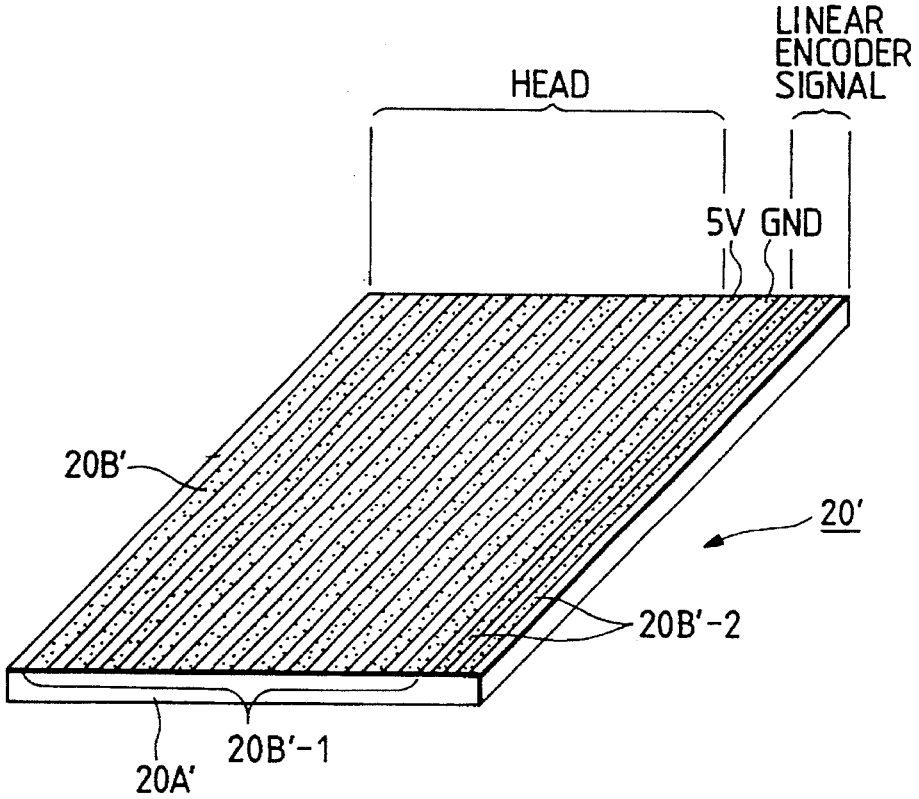
FIG. 4 is also a perspective view of another example of a cable 20 of the present invention.
Figure 7:
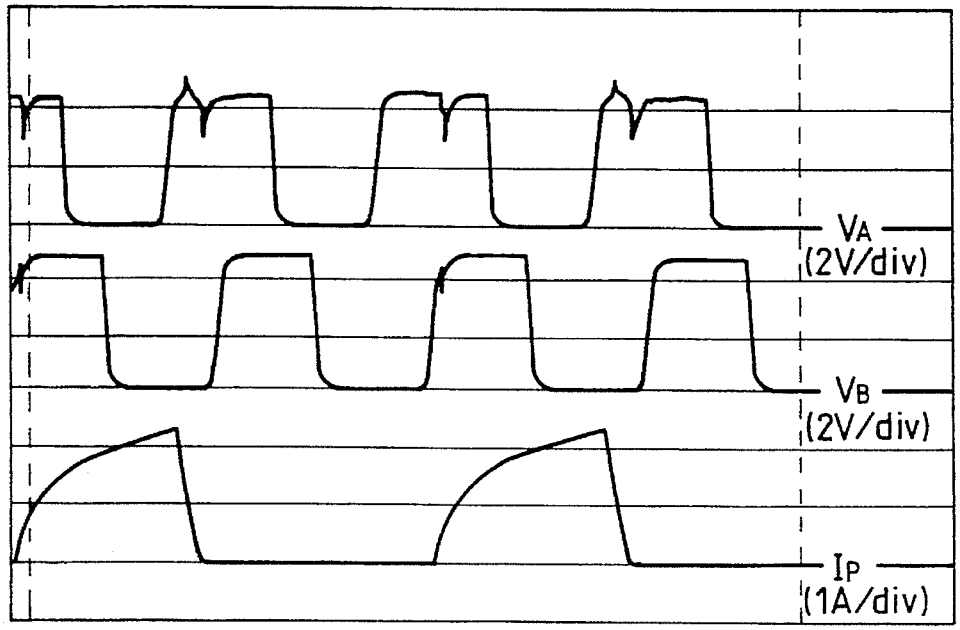
FIG. 7 PRIOR ART
FIG. 7 is a waveform diagram of the signals transmitted in the conductive strips of the conventional cable of FIG. 8.

FIG. 4 shows another example of a FPC 20' of the present invention which is constructed of a single layer. The FPC 20' comprises a sheet-like substrate 20A' on which conductive strips 20B' are formed. The narrow conductive strips 20B'-2 transmit output signals of the linear encoder 32 and are located on the right-most portion of the sheet-like substrate 20A'. Furthermore, the wide conductive strips 20B'-1, which supply current to the printing head 31, are located on the left-most portion of the sheet-like substrate 20A'. Therefore, as in the previous two examples, the narrow conductive strips 20B'-2 are separated from the wide conductive strips 20B'-1. As a result, the problem of electromagnetic and electrostatic noise interfering with the signals transmitted in the narrow conductive strips 20B'-2 is eliminated.

In addition, the wide conductive strips of the previous examples may supply current to other printer devices (e.g. a fan motor) as well as supply current to the printing head 31. Also, the narrow conductive strips may transmit other signals which are adversely affected by noise as well as output signals transmitted by the linear encoder 32 (e.g. signals from a thermistor and signals from a device for detecting the width of the recording sheet 40). However, the FPC of the present invention will also eliminate the noise in the other transmitted signals which is caused by current supplied to other devices.

Figure 6:
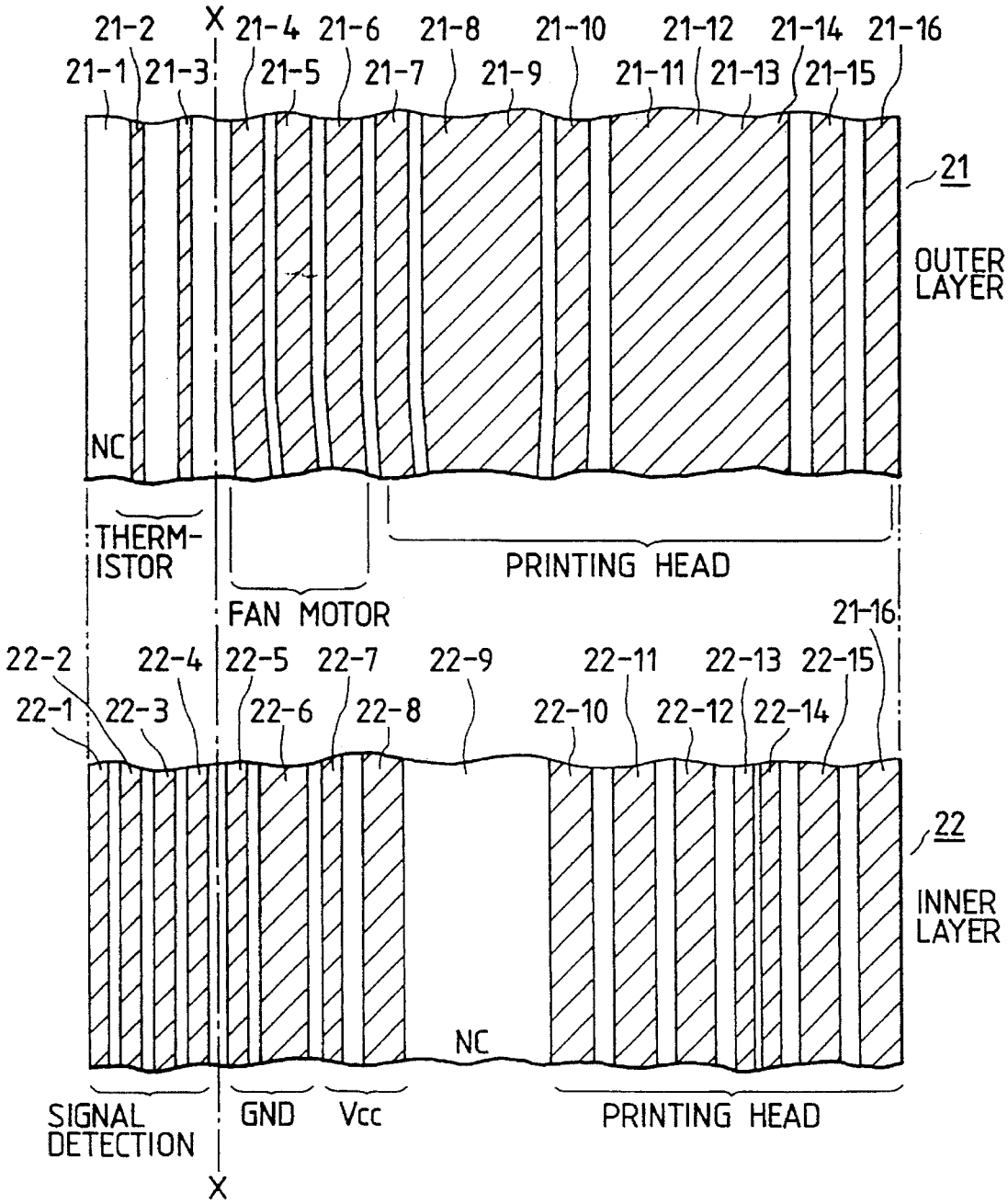
FIG. 6 is a diagram of another example of a cable of the present invention.
Figure 8:
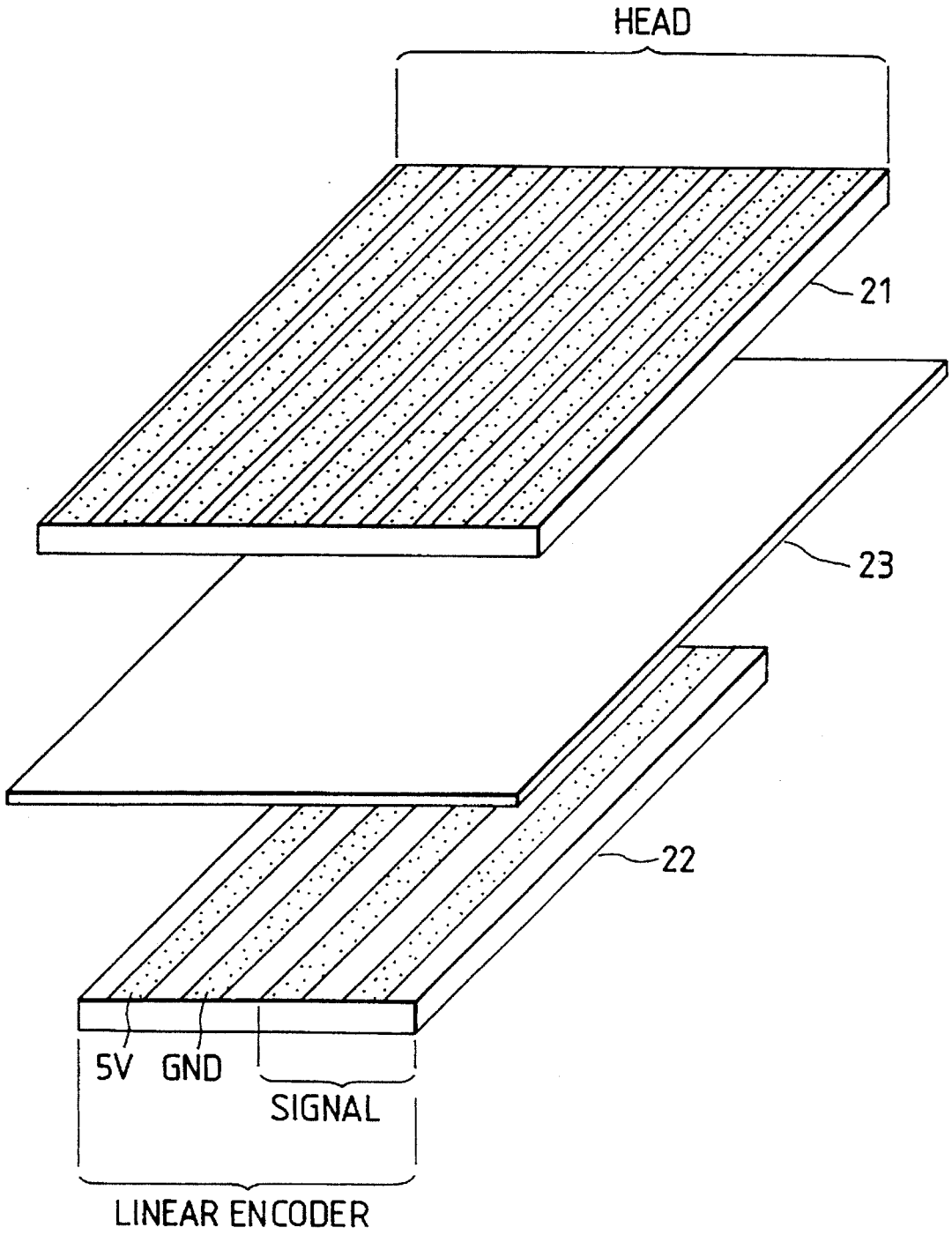
FIG. 8 PRIOR ART
FIG. 8 is a perspective view of the structure of a conventional cable.

FIG. 6 shows another example of an FPC 20 of the present invention. There are two FPC layers, i.e., a first layer 21 and a second layer 22. Sixteen conductive strips are formed on the first layer 21 and are assigned as follows. The conductive strip 21-1 is not connected to any printer device and is labeled NC (not connected), the narrow conductive strips 21-2 and 21-3 transmit signals from a thermistor, the wide conductive strips 21-4 through 21-6 supply current to a fan motor, and the wide conductive strips 21-7 through 21-16 supply current to the printing head 31. Similarly, sixteen conductive strips are formed on the second layer 22 and are assigned as follows. The narrow conductive strips 22-1 through 22-4 transmit signal detection signals, the conductive strips 22-5 and 22-6 are used for ground (GND), the conductive strips 22-7 and 22-8 supply voltage from a power source (Vcc), the conductive strip 22-9 is not connected to any printer device and is labeled NC, and the wide conductive strips 22-10 through 22-16 supply current to the printing head 31.

In FIG. 6, the line X—X illustrates that the narrow conductive strips 21-2, 21-3, and 22-1 through 22-4, which transmit signals, are not intertwined with or are disposed above or below the wide conductive strips 21-4 through 21-16 and 22-10 through 22-16, which supply current to the printing head and other devices. In other words, in the first layer 21, only the narrow conductive strips 21-2 and 21-3 and, in the second layer 22, only the narrow conductive strips 22-1 through 22-4 are located to the left of the line X—X. As a result, noise from the currents and voltages on the wide conductive strips on the right side of the line X-X do not interfere with the transmitted signals.

Figure 5A:
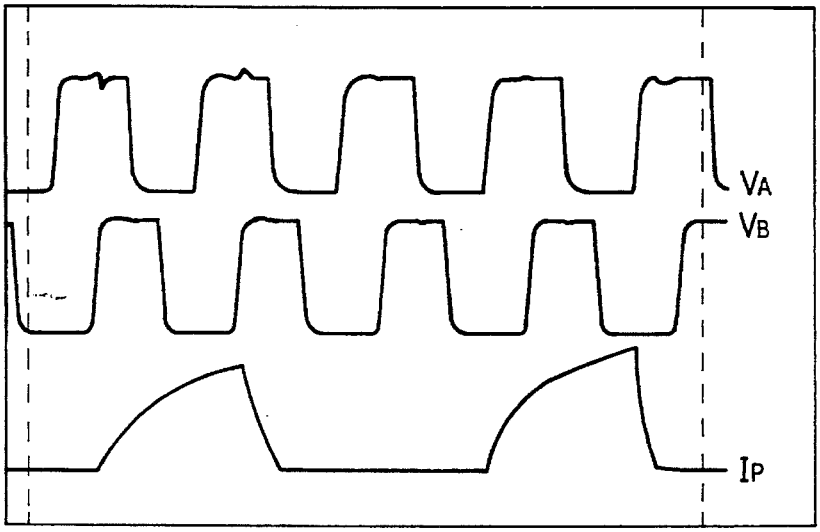
FIGS. 5(*a*) and 5(*b*) are illustrations of waveform diagrams of the signals transmitted in the conductive strips of the first layer 21 and second layer 22 of FIG. 6.
Figure 5B:
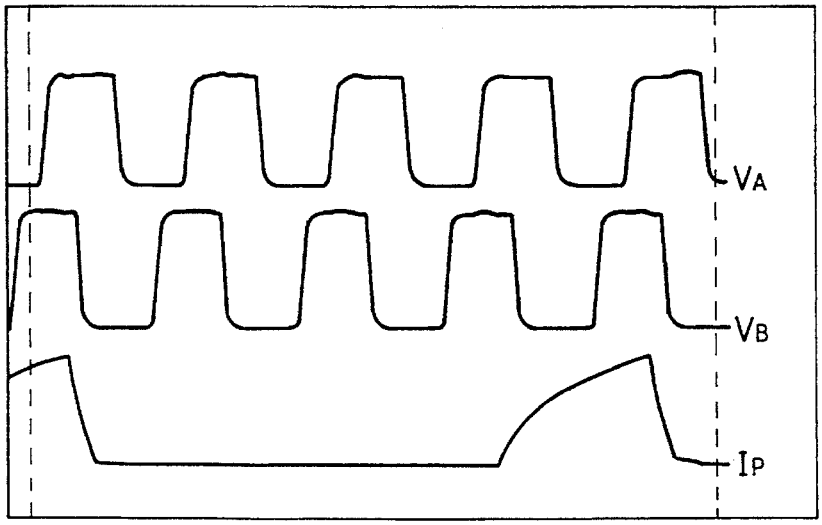

FIG. 5(*a*) shows the effects of the reduction of the noise on the narrow strips of the encoder ($V_A$, $V_B$) in response to the currents of the printing head (e.g. $I_P$) supplied on the wide conductive strips, when the width of the narrow conductive strips is 0.4 mm. When the narrow conductive strips 21-2 and 21-3 of the first layer 21 and the narrow conductive strips 22-1 through 22-4 of the second layer 22 are small in width, there is barely any electrostatic connection between the signals on the narrow conductive strips and the currents on the wide conductive strips, even though the narrow conductive strips and the wide conductive strips are close to each other in a projected plane (i.e., a relationship wherein the narrow and wide strips are located exactly below above each other). Therefore, the currents barely generate any electrostatic noise in the signals on the narrow conductive strips.

FIG. 5(*b*) shows the effects of the reduction of the noise on the narrow strips of the encoder ($V_A$, $V_B$) in response to the currents of the printing head (e.g. $I_P$), when the edge of the wide conductive strip 21-4 of the first layer 21 is spaced 2 mm away from the edge of the narrow conductive strip 22-4 of the second layer in the projected plane. In this case, the noise is even less than in the situation illustrated by FIG. 5(*a*).

Thus, as described above, the effect of the noise on the signals in the narrow conductive strips can be reduced by narrowing the width of the narrow conductive strips. Furthermore, the noise on the signals can be virtually eliminated if the wide conductive strips and narrow conductive strips are separated from each other in the projected plane, in addition to narrowing the width of the narrow conductive strips.

The embodiment of the present invention has been described with reference to a FPC in which conductive strips are formed on a flexible substrate. However, instead of a FPC, the invention may be applied to a flexible flat cable (FFC). In a FFC, a plurality of separate insulated wires are arranged in parallel with one another, and their insulating covers are welded together. As one can readily observe, the technical concept of the present invention is also applicable to an FFC.

In addition, the previous description of the preferred embodiments is provided to enable any person skilled in the art to make or use the present invention. The various modifications to these embodiments will be readily apparent to those skilled in the art, and the generic principles defined herein may be applied to other embodiments without the use of inventive faculty. Therefore, the present invention is not intended to be limited to the embodiments described herein but is to be accorded the widest scope consistent with the principles and novel features disclosed herein.

What is claimed is:

1. A carriage-connecting device in a serial printer, comprising:

a serial printer body;

a cable;

a carriage, which has a printing head and a sensor, connected to said serial printer body via said cable, said printing head is driven by electric power supplied to said printing head through said cable, signals, which are generated by said sensor, are transmitted between said serial printer body and said carriage through said cable, said cable comprises a sheet-like substrate and a plurality of conductive strips which are formed on said substrate and said conductive strips extend in a longitudinal direction of said sheet-like substrate, said plurality of conductive strips comprise at least one wide conductive strip supplying said electric power and at least one narrow conductive strip for transmitting said signals, said at least one wide conductive strip and said at least one narrow conductive strip are spaced on said sheet-like substrate in such a manner as to reduce the amount of noise caused by said electric power in said signals transmitted in said at least one narrow conductive strip.

2. A carriage-connecting device as claimed in claim 1, wherein said sheet-like substrate comprises a first layer which includes a first substrate and at least one of said plurality of conductive strips and comprises a second layer which includes a second substrate and at least one other of said plurality of conductive strips.

3. A carriage-connecting device as claimed in claim 1, wherein said at least one narrow conductive strip is located at one side of said sheet-like substrate and said at least one wide conductive strip is located at another side of said sheet-like substrate wherein said another side of said sheet-like substrate is opposite to said one side of said sheet-like substrate.

4. A carriage-connecting device as claimed in claim 2, wherein:

said at least one narrow conductive strip is located at one side of one of said first substrate and said second substrate; and said at least one wide conductive strip is located at another side of one of said first substrate and said second substrate, wherein said another side is opposite to said one side.

5. A carriage-connecting device as claimed in claim 4, wherein said at least one narrow conductive strip is located on said first substrate and said at least one wide conductive strip is located on said second substrate in such an manner that said at least one narrow conductive strip is not disposed directly above or below said at least one wide conductive strip.

6. A carriage-connecting device as claimed in claim 3, wherein said at least one narrow conductive strip is no wider that 0.4 mm.

7. A carriage-connecting device as claimed in claim 5, wherein said at least one narrow conductive strip is no wider that 0.4 mm.

8. A carriage-connecting device as claimed in claim 4, wherein said first substrate and said second substrate are separated by a distance of at least 1 mm.

9. A carriage-connecting device as claimed in claim 7, wherein said first substrate and said second substrate at separated by a distance of at least 1 mm.

10. A carriage-connecting device as claimed in claim 1, further comprising a pressing member which presses said sheet-like substrate in a direction of thickness thereof.

11. A carriage-connecting device as claimed in claim 2, further comprising a pressing member which presses said sheet-like substrate in a direction of thickness thereof.

12. A carriage-connecting device as claimed in claim 4, wherein:

said at least one narrow conductive strip is located at said one side of said first substrate;

a second narrow conductive strip is located at said one side of said second substrate; and said at least one wide conductive strip is located at said another side of said first substrate.

13. A carriage-connecting device as claimed in claim 4, wherein:

said at least one narrow conductive strip is located at said one side of said first substrate;

said at least one wide conductive strip is located at said another side of said second substrate; and a second wide conductive strip is located at said another side of said first substrate.

14. A carriage-connecting device as claimed in claim 4, wherein:

said at least one narrow conductive strip is located at said one side of said first substrate;

a second narrow conductive strip is located at said one side of said second substrate;

said at least one wide conductive strip is located at said another side of said first substrate; and a second wide conductive strip is located at said another side of said second substrate.

15. A carriage-connecting device as claimed in claim 4, wherein:

said at least one narrow conductive strip is located at said one side of said first substrate; and said at least one wide conductive strip is located at said another side of said second substrate.

* * * * *